United States Patent [19]

Burton et al.

[11] 4,271,767

[45] Jun. 9, 1981

[54] SHEET PRODUCTION SYSTEM

[75] Inventors: Perry E. Burton; Charles E. Brocklehurst, both of Fountain Inn, S.C.

[73] Assignee: Opelika Manufacturing Corporation, Chicago, Ill.

[21] Appl. No.: 34,402

[22] Filed: Apr. 30, 1979

Related U.S. Application Data

[62] Division of Ser. No. 956,792, Nov. 1, 1978.

[51] Int. Cl.[3] ..... D05B 21/00

[52] U.S. Cl. ..... 112/2; 112/121.11; 112/143; 112/153; 112/304; 112/130; 271/188

[58] Field of Search ..... 112/121.11, 121.12, 112/121.15, 121.29, 10, 2, 304, 303, 141–143, 151, 130; 270/93; 271/188, 197, 174, 69, 225, 226

[56] References Cited

U.S. PATENT DOCUMENTS

| | | | |
|---|---|---|---|
| 2,053,257 | 9/1936 | Anderson | 112/2 |
| 2,738,746 | 3/1956 | MacIsaac, Jr. et al. | 112/2 X |
| 2,940,404 | 6/1960 | Damon | 112/10 |
| 2,962,989 | 12/1960 | Golden | 112/10 |
| 3,477,397 | 11/1969 | Hawley | 112/304 X |
| 3,489,113 | 1/1970 | Flanagan | 112/2 |
| 3,580,198 | 5/1971 | Teed et al. | 112/121.11 |
| 3,955,515 | 5/1976 | Elsas | 112/262.2 |
| 4,154,180 | 5/1979 | Burton | 112/121.29 X |

*Primary Examiner*—H. Hampton Hunter
*Attorney, Agent, or Firm*—Jones, Thomas & Askew

[57] ABSTRACT

Sheet material is taken from a supply, moved along its length to a cutting station, an edge thereof is hemmed as it moves toward the cutting station, the sheet material is cut into segments, and the cut segments are moved parallel to their cut edges, the cut edges are hemmed, and the segments are folded. At the cutting station the leading portion of the sheet material is gripped and pulled from the entrance to the cutting station to the other side thereof, a slack bar is moved downwardly into the segment of sheet material in the cutting station to form slack in the segment, the sheet material is clamped adjacent the entrance to the cutting station and the segment in the cutting station is clamped against parallel conveyor tapes. A cutting disc is drawn across the sheet material at the entrance to the cutting station, and the parallel conveyor tapes move the sheet parallel to its cut edges to a hemming station where the edges are folded and hemmed.

13 Claims, 20 Drawing Figures

Fig. 2
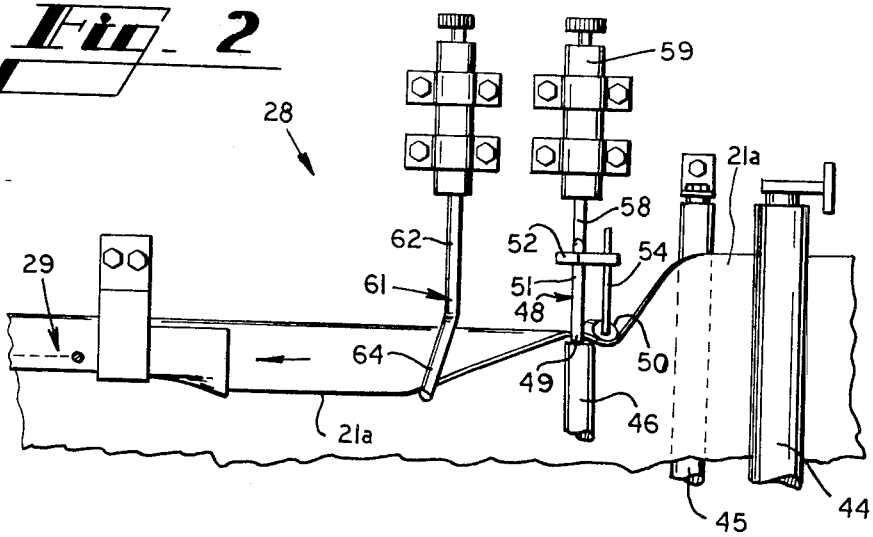
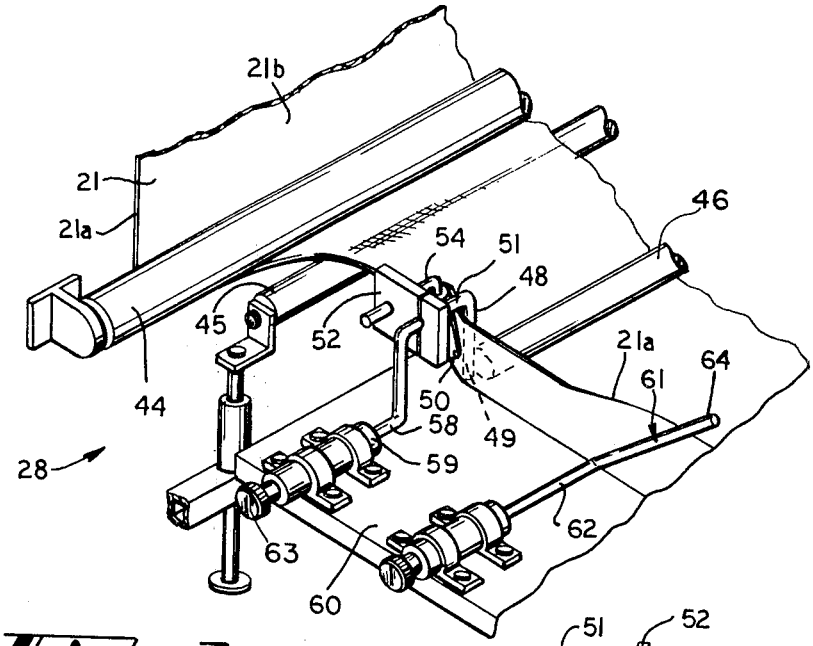
Fig. 3
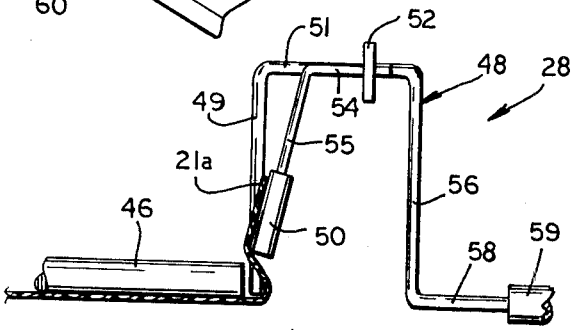
Fig. 4

SHEET PRODUCTION SYSTEM

This is a division of application Ser. No. 956,792, filed Nov. 1, 1978.

DESCRIPTION

1. Technical Field

This invention relates to the manufacture of bed sheets, towels, tablecloths, curtains and other flat goods wherein sheet material is moved from a supply along its length to a cutting station, one or more of its edges are hemmed as it moves to the cutting station, the sheet material is cut into segments, and the cut edges of the segments are hemmed.

2. Background

In the production of flat goods, such as bed sheets, towels, etc., the goods usually are cut from a supply of sheet material and the cut edges are hemmed. In some situations the side edges of the cut segments of sheet material do not need to be hemmed since the side edges comprise the selvage of the sheet material.

Various automatic machines have been developed and used for cutting ahd hemming sheet material. For example, U.S. Pat. Nos. 3,580,198, 3,640,235, 3,772,948, 3,906,878, and 3,955,515 all illustrate systems which are capable of automatically cutting segments from sheet material and hemming the cut edges of the segments. However, it is believed that the prior art devices have experienced some difficulty in controlling the cut edges of the segments of sheet material as the cut edges are being moved to and through a hemmer. In addition, the speed of operation of the prior art systems has been somewhat slow since speed of the overall equipment was limited by the speed of operation of the hemmers and the coordination between the feeding and cutting steps upstream from the hemmers is a faster, but intermittent operation which require coordination between the cutter and the hemmers of the systems.

In the past, it has been customary to manufacture bed sheets with the side edges of the bed sheets formed from the selvage from the loom, and with the head and foot edges of the sheet folded over and sewn in a hem. This procedure was thought to be economical since it avoided folding and hemming the side edges and required only the folding and hemming of the head and foot edges; however, when manufacturers began making bed sheets in not only single and double bed sizes but also in queen and king sizes, different sized looms had to be used to manufacture each size so as to provide the sheets in the desired widths. Thus, when it was desired to have bed sheets manufactured in four sizes with a particular design imprinted thereon, four looms had to be used to manufacture the sheets, and the dyeing equipment had to accommodate all four sizes.

While it has been known in the industry that sheets can be fabricated having their side edges folded and hemmed as well as having a hem formed at the head of the sheet, this requires three edges of the sheet product to be folded and hemmed, which is an extra and an expensive step in the prior art manufacturing processes.

SUMMARY OF THE INVENTION

Briefly described, the present invention comprises a sheet production system which moves sheet material from a supply along its length toward a cutting station, optionally folds at least one edge portion of the moving sheet material over and sews through it to form a first hem, then cuts the sheet material into segments, and moves the segments parallel to their cut edges to hemmers where the cut edges are folded and sewn into hem. A gripper moves across the cutting station to the entrance of the cutting station to grip the previously cut leading edge of the sheet material, and then moves back across to the far side of the cutting station, pulling the sheet material over a pair of parallel conveyor tapes and into the cutting station. A slack bar moves down into the segment of sheet material between the parallel conveyor tapes at the cutting station, causing slack to be formed in the segment, and a clamp at the entrance of the cutting station grips and holds the segment in position while conveyor clamps move down toward the conveyor tapes to clamp the segment against the conveyor tapes. A disc cutter is then drawn across the sheet material at the entrance of the cutting station, to cut the segment away from the supply of sheet material. The gripper then releases the cut segments and the conveyor tapes move the cut segment in a direction parallel to its cut edges at a high velocity on into a hemming station and over a second pair of parallel conveyor tapes. A second pair of clamp members move down to clamp the segment of sheet material against the second pair of parallel conveyor tapes, and the second pair of parallel conveyor tapes move the cut segment of sheet material at a slower rate of movement on into the sewing machines of the hemming station in timed relationship with the sewing machines, where the cut edges of the segment are folded over and sewn into a hem.

After hemming, the segment of sheet material is folded for shipment and ultimate sale to a customer.

Thus, it is an object of this invention to provide a sheet production system which functions to cut segments from a supply of sheet material and to form folded and sewn hems along at least three edges of the cut segments.

Another object of this invention is to provide a sheet production system which is capable of cutting sheet material into segments of different widths and of hemming the cut edge of the sheet material.

Another object of this invention is to provide a sheet production system which functions accurately and expediently to form hemmed sheets from a supply of sheet material.

Other objects, features and advantages of the present invention will become apparent upon reading the following specification, when taken in conjunction with the accompanying drawings.

BRIEF DESCRIPTION OF THE DRAWINGS

FIG. 2 is a top view of a pre-folder.

FIG. 3 is a perspective illustration of the pre-folder of FIG. 2.

FIG. 4 is an elevational view of a portion of the pre-folder of FIGS. 2 and 3.

DETAILED DESCRIPTION

Figure 1:
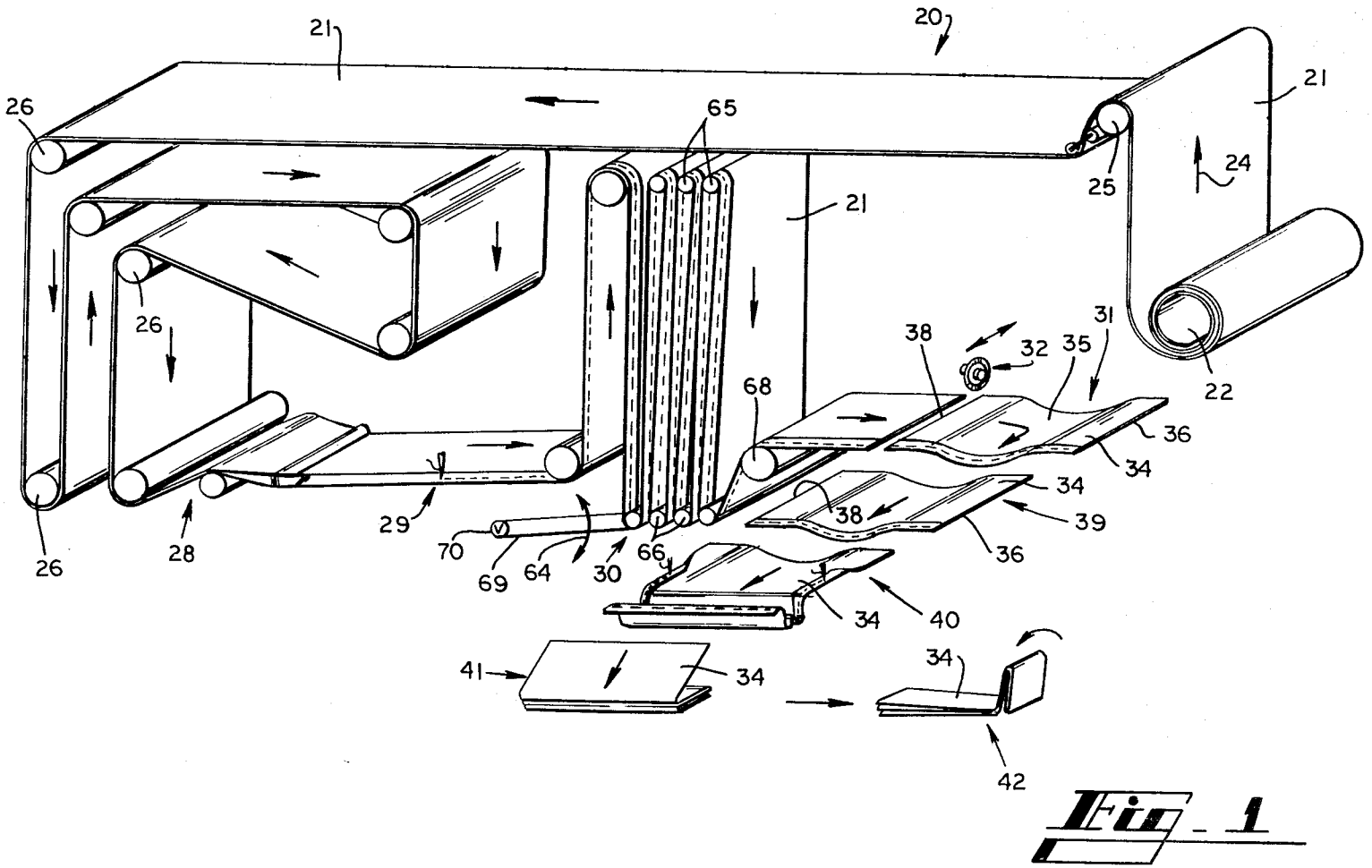
FIG. 1 is a schematic perspective illustration of the sheet production system.

Referring now in more detail to the drawings, wherein like numerals indicate like parts throughout the several views, FIG. 1 schematically illustrates the sheet production system 20, wherein sheet material 21 is taken from a supply such as reel 22 and fed in an upward direction 24 by a driven feed roller 25 at an inspection station where a worker inspects the sheet material for flaws, etc. The flaws are marked with a liquid so that the flaws can be detected at the cutting station and the cut segment which includes a flaw can be identified. The particular sheet inspection and marking system suitable for use in this invention is disclosed in U.S. Patent Application Ser. No. 957,791 filed in the U.S. Patent and Trademark Office on Nov. 1, 1978, now U.S. Pat. No. 4,204,012, dated May 20, 1980. The sheet material 21 moves from driven roller 25 on through a series of guide rollers 26, through pre-folder 28, side hemmer 29, accumulator 30, to cutting station 31. A cutter 32 cuts across the sheet material to form cut segments 34. Slack 35 is formed in the sheet material at the cutting station 31 just prior to cutting the sheet material, so that the cut segments 34 have slack therein as they are moved parallel to their cut edges 36 and 38 through transfer station 39 to hemming station 40, and then to pleat folder 41 and spiral folder 42. The sewing machines and hemming attachments used at hemming station 40 are illustrated in U.S. Pat. No. 3,906,878 and the pleat and spiral folder 41 and 42 are illustrated in U.S. Patent No. Application Ser. No. 954,935 filed in the U.S. Patent and Trademark Office on Oct. 26, 1978, now U.S. Pat. No. 4,227,684 issued Oct. 14, 1980. An improved needle lubrication system of the type disclosed in U.S. Patent No. Application Ser. No. 954,934 filed in the U.S. Patent and Trademark Office on Oct. 26, 1978 is used with the sewing machines in hemming station 40 in order to increase the speed of production of the sheet production system. If it is desired to place labels in the finished product, a label dispenser of the type disclosed in U.S. Pat. No. 4,157,692 can be utilized at the hemming station As illustrated in FIGS. 2–4, the pre-folder 28 includes a first guide roller 44 which guides the sheet material 21 downwardly and beneath the guide roller and then up an incline, and a second guide roller 45 which is located at a level higher than the first guide roller 44 which guides the sheet material up the incline and over the roller, and then a third guide 46 which is located lower than second guide roller 45. Guide rollers 44 and 45 are wider than the width of the sheet material, so that the sheet material is spread flat across these rollers. Third guide 46 is displaced inwardly from the path of the edge 21*a* of the sheet material, and an inverted U-shaped guide bar 48 is attached to the end of third roller 46. The upwardly extending leg 49 of the U-shaped guide bar 48 is attached at its lower end to the third guide 46, so that a right angle guide is formed inwardly of the edge 21*a* of the sheet material 21. A small roller 50 is mounted from the cross bar 51 of the U-shaped guide bar 48, with the bracket 52 mounted on the cross bar 51, L-shaped stem extending from the bracket 52 downwardly adjacent the leg 49 of the U-shaped guide bar 48, and with the roller 50 rotatably mounted on leg 55 of the L-shaped stem 54. Small roller 50 is inclined so that its lower end is positioned forwardly along the direction of movement of the sheet material with respect to its upper end, and with its lower end positioned inwardly toward the centerline of the sheet material with respect to its upper end. This particular attitude of small roller 50 assists in tending to lift and maintain the side edge portion 21*a* in the bight of the U-shaped guide bar 48, keeping the sheet material from migrating downwardly and out of the guide bar.

The other leg 56 of the U-shaped guide bar 48 is connected at its lower end to horizontal adjustment bar 58, and bar 58 is externally threaded and received in socket 59 which is anchored to the work table 60. Rotation of the knob 62 moves U-shaped guide bar 48 further into or away from sheet 21, thereby increasing or decreasing the width of the fold to be made in the sheet material.

Finger guide 61 is supported on work table 60 and includes stem 62 and upwardly inclined guide portion 64 which is angled inwardly over the sheet material 21 and angled along the direction of the movement of the sheet material toward hemmer 29. The guide portion 64 tends to further fold over the side edge portion 21*a* onto the main body of the sheet material as the sheet material leaves the U-shaped guide bar 48 and moves toward the needle of the hemmer 29.

The pre-folder 28 requires the central portion 21*b* of the sheet material to move over the second roller 45 which functions as a first guide means, with the sheet material being oriented in an unfolded configuration, and then the central portion 21*b* is required to move down an incline beneath the third guide 46 which functions as a second guide means. The central portion of the sheet material then moves horizontally across the work table 60 to the hemmer, which functions as a third guide means. In the meantime, the side edge portion 21*a* does not have to move beneath guide 46, but takes a shortcut through U-shaped guide bar 48. Since the side edge portion 21*a* is taking a short cut, the slack formed in the side edge portion can be utilized to fold or twist the side edge portion over onto the central portion 21*b*, to form the fold. The side hemmer 29 then sews the folded side edge portion 21*a* to the main body of the sheet material.

As illustrated in FIG. 1, the sheet material leaves side hemmer 29 and then moves into accumulator 30. The accumulator 30 comprises a plurality of stationary upper guide bars 65, and a plurality of lower movable guide bars 66. The sheet material moves in a serpentine path that extends alternately about the upper and lower guide bars 65 and 66, and then about feed roll 68 on into cutting station 31. The lower guide bars 66 are each mounted at their ends to levers 69 which are each pivotal at one end thereof 70 as indicated by arrow 64, so that the sheet material can be continuously accumulated in the accumulator during the continuous operation of the side hemmer 29 and intermittently fed away from the accumulator to the cutting station 31. A switch and control means (not shown) initiate and terminate the operation of side hemmer 29 and the various drive rollers in the system in response to the position of end levers 69 of the accumulator 30.

Figure 5:
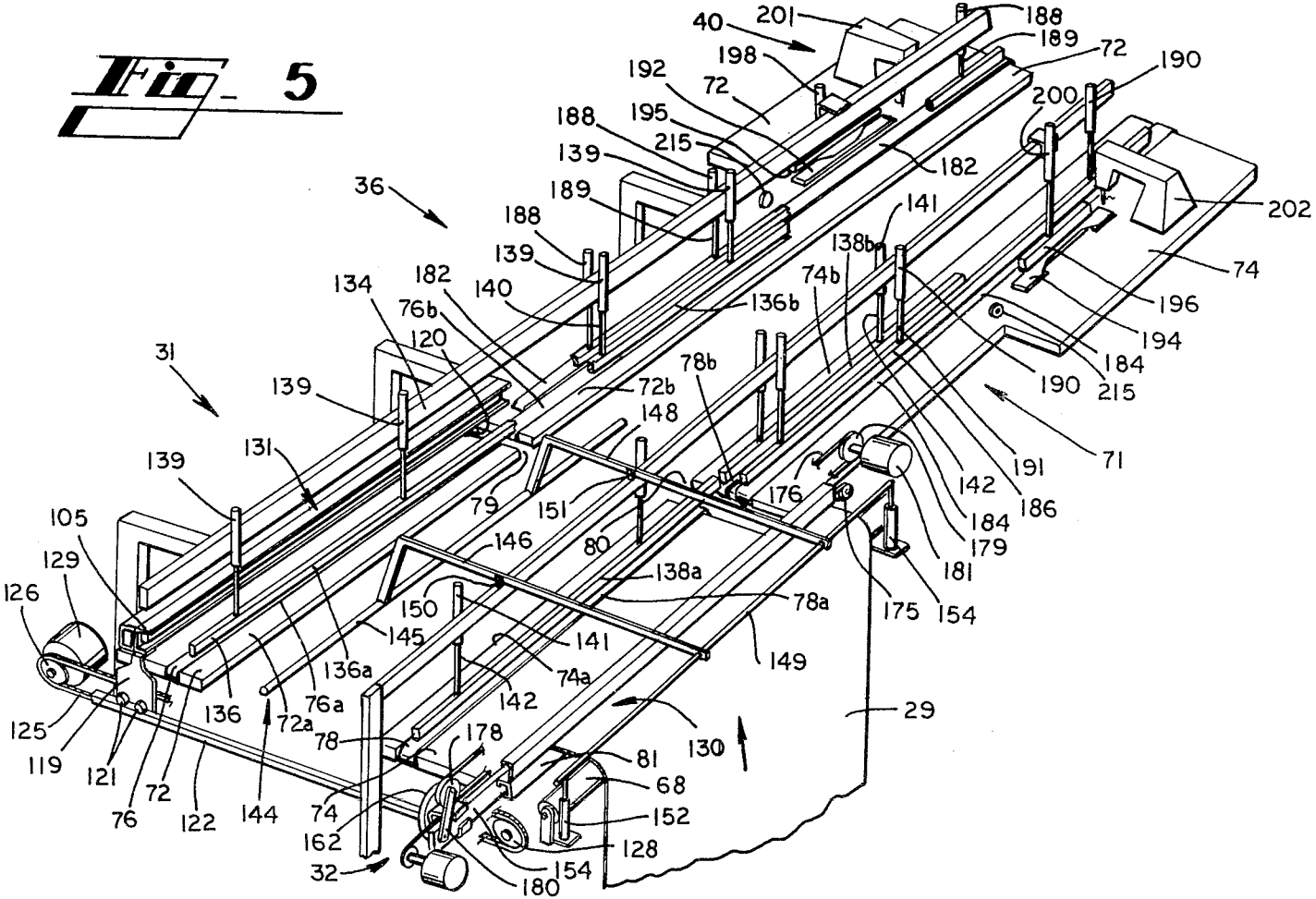
FIG. 5 is a perspective illustration, with parts removed for clarity, of the cutting, transfer and hemming stations of the sheet production system.

As illustrated in FIG. 5, the cutting station 31, the transfer station 36, and the hemming station 40 are all located in a single framework and work table assembly 71. While the details of the framework are not illustrated, the work table comprises two separated work tables 72 and 74 which extend parallel to each other and which define central open space 75. The work tables are movable toward and away from each other to form the cut segments of sheet material in different widths. This is accomplished with an electric motor and drive system (not illustrated). A conveyor tape assembly 76 is located in and along work table 72 while a similar conveyor tape assembly 78 is located in and along work table 74. Each work table 72 and 74 is broken at 79 and 80 to form a passage through the work tables, and forming the work tables in sections 72*a* and 72*b* and 74*a* and 74*b*. The conveyor tape assemblies 76 and 78 are also broken at passageways 79 and 80, with the conveyor tape assemblies being formed in sections 76*a* and 76*b* and 78*a* and 78*b*. The conveyor tapes 76 and 78 are spaced from each other and are parallel to each other and extend at a right angle with respect to the direction of movement of the sheet material 29 as the sheet material enters the cutting station.

Clamp assembly 81 (FIGS. 5 and 7–9) is located at the entrance of cutting station 31 adjacent feed roll 68. Clamp assembly 81 includes upper frame 82 and lower frame 84 which are vertically spaced apart and which permit the passage therebetween of sheet material 21. A rectilinear clamp bar 85 is mounted on the ends of a plurality of cylinder rods 86, and a plurality of pneumatic cylinders 88 are mounted in the upper frame 82. The clamp bar 85 defines an elongated slot 89 in its bottom surface, and an elongated elastic tube 90 is present in the slot 89. Tube 90 protrudes from the bottom surface of the bar 85 toward lower frame 84. Lower frame 84 has an upper horizontal surface 91 over which the sheet material 21 moves, and against which clamp bar 85 and its tube 90 bear. When clamp bar 85 is moved to its down position by its cylinders 88, the clamp bar holds the sheet material 21 against the upper horizontal surface 91 of the lower frame 84, with the flexible tube 90 bearing against the sheet material 21 and the upper horizontal surface 91.

Lower frame 84 includes platform 92 that extends toward cutting station 31. Movable support means 94 rests on platform 92 and comprises a rectilinear beam of inverted U-shaped cross-sectional shape including top surface 95 and downward extending legs 96 and 98. A plurality of guide pins 99 extend through both legs 96 and 98 of movable support means 94 and through the upright wall portion 100 of lower frame 84. A coil compression spring 101 surrounds that portion of each guide pin 99 between beam 94 and the upright wall portion 100 of lower frame 84, and the end heads 102 and 104 of the guide pins 99 limit the movement of the beam 94 away from the upright wall portion 100. Thus, springs 101 bias the movable support means 94 to the position illustrated in FIGS. 8 and 9.

Gripping bar 105 comprises a channel shaped beam 106 which includes top wall 108, side wall 109 and bottom wall 110. Rectangular support beam 111 is mounted to the side wall 109 of channel beam 106 and supports the channel beam as illustrated. A plurality of pneumatic cylinders 112 are mounted to top wall 108 of channel beam 106, and clamp bar 114 is supported by the cylinder rods 115 of cylinders 112. The clamp bar 114 is rectilinear and includes a rectilinear slot 116 in its lower surface, and an elongated elastic tube 118 fits in slot 116. The arrangement is such that the clamp bar 114 and its tube 118, functioning as an upper clamp member are moved toward and away from bottom wall 110, which functions as a lower clamp member, whereby the assembly functions as a gripping means.

As illustrated in FIG. 5, gripping bar 105 is mounted at its ends on trolleys 119 and 120, with each trolley being supported by its wheels 121 on a track 122. A continuous chain drive 124 comprising chain 125, end sprockets 126 and 128 and air motor 129 function to move each trolley 119 and 120 along its track 122. Trolley 119 moves adjacent the end of work table 72 and 74 while trolley 120 moves through the passageways 79 and 80 which are formed between the work table sections 72*a* and 72*b* and 74*a* and 74*b*. Thus, gripping means 105 can be moved back and forth across cutting station 31 from the entrance 130 at clamp assembly 81 to the other side 131 which is the home position of gripping means 105. It will be noted that the gripping bar 105 is long enough so that it extends beyond its trolley 120 and beyond the passages 79 and 80.

Figure 7:
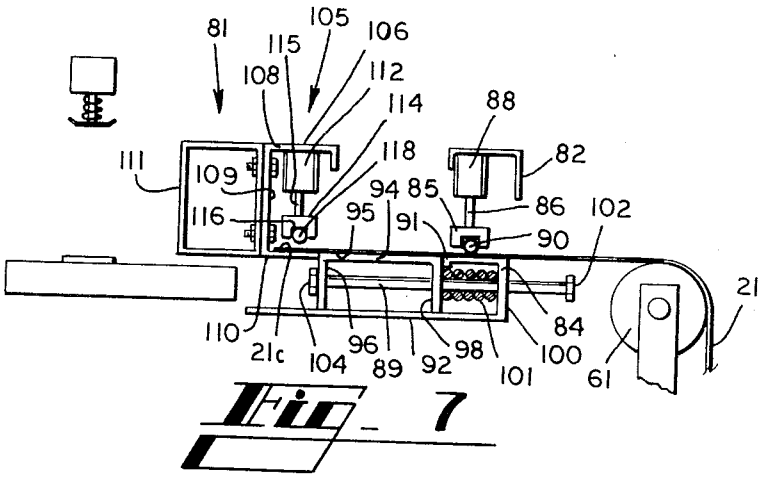
FIGS. 7–14 are progressive schematic illustrations of how the sheet material is gripped and pulled across the cutting station, how slack is formed in the sheet material, how the segment of sheet material in the cutting station is cut from its supply, and how the conveyor tapes and conveyor clamps function to move the cut segment from the cutting station through the transfer station to the hemming station.

As illustrated in FIG. 7, when gripping means 105 moves from its home position 131 across cutting station 31 to the entrance of the cutting station, it moves into abutment with movable support means 94, with the lower clamp member 110 abutting the leg 96 of the movable support means 94. This causes the movable support means to move against the bias of its spring 101, so that the lower clamp member 110 moves in beneath the leading edge portion 21*c* of the sheet material 21. When the gripping bar 105 is in this position the upper clamp member 114 is moved down by its pneumatic cylinders 112 so that the leading edge portion 21*c* is gripped between the upper clamp member 114 and the lower clamp member 110. When the gripping bar then begins its movement from the entrance 130 back to its home position 131, it pulls the sheet material 21 with it. In the meantime, clamp assembly 81 opens so as to allow the sheet material 21 to pay out and move with gripping bar 105.

As illustrated in FIG. 5, the framework of the work table assembly 71 includes parallel support beams 134 and 135 which extend from cutting station 31 through transfer station 36 to hemming station 40. The parallel support beams 134 and 135 are supported over work tables 72 and 74, and conveyor tape clamp bars 136 and 138 are supported from the support beams 134 and 135. Pneumatic cylinders 139 are spaced along support beam 134 and their rods 140 are connected to and support clamp bar 136, while pneumatic cylinders 141 are spaced along support beam 135 and their rods 142 are connected and support conveyor tape clamp bar 138. The clamp bars 136 and 138 are positioned over the conveyor tapes 76 and 78 and are movable by cylinders 139 and 141 down toward abutment with the conveyor tapes. Thus, when sheet material 29 is extended across the cutting section 31 by gripping bar 105, the clamp bars 136 and 138 are movable down into engagement with the sheet material to urge the sheet material into frictional contact with the conveyor tapes, so that when the conveyor tapes begin their movement, the sheet material will be moved with the conveyor tapes.

Clamp bars 136 and 138 are broken into sections 136*a* and 136*b* and 138*a* and 138*b*, with the sections 136*a* and 138*a* extending over the passage 79 and 80, so that the end portions of the clamp bars 136*a* and 138*b* span the passageways 79 and 80. The sections 136*b* and 138*b* are aligned with the sections 136*a* and 138*a*.

Figure 8:
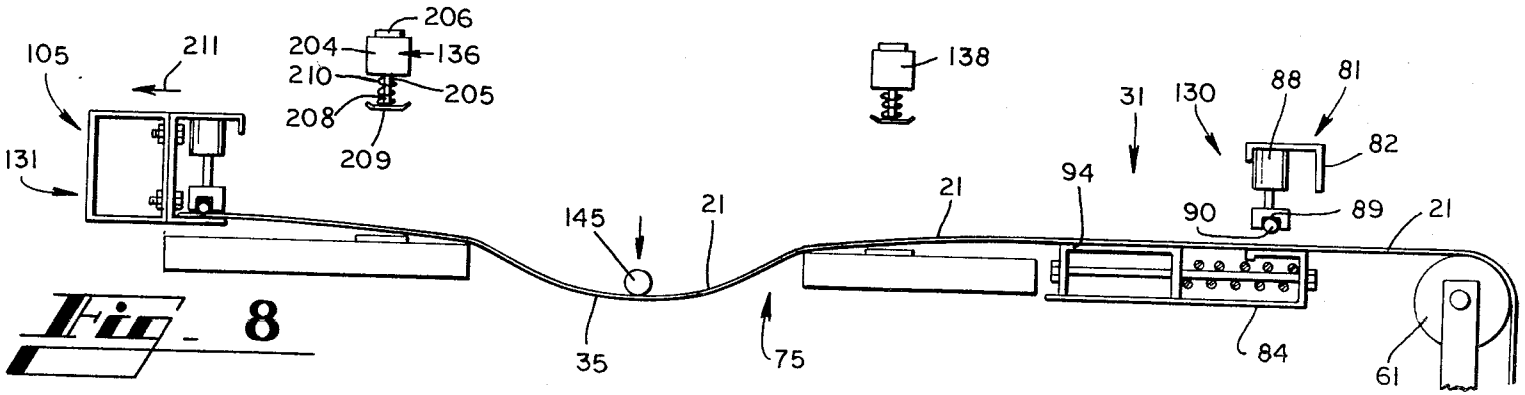

Slack bar assembly 144 is mounted on support beam 135 and includes rectilinear slack bar 145 that extends parallel to conveyor tapes 76 and 78 and which is located in the central open space 75, L-shaped support legs 146 and 148, and rear connector bar 149. Clevises 150 and 151 pivotally connect the L-shaped support legs 146 and 148 to the support beam 135. Pneumatic cylinders 152 and 154 are mounted at the ends of rear connector bar 149 and function to pivot the slack bar assembly 144 about support beam 135, so that its slack bar 145 moves down into the plane of the sheet stretched across the central open space 75 (FIG. 8).

Figure 6:
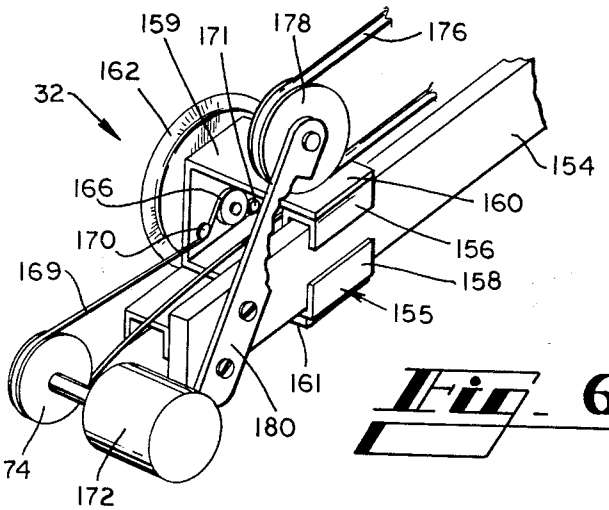
FIG. 6 is a perspective detail illustration of the cutter.
Figures 9, 10, 11, 12, 13:
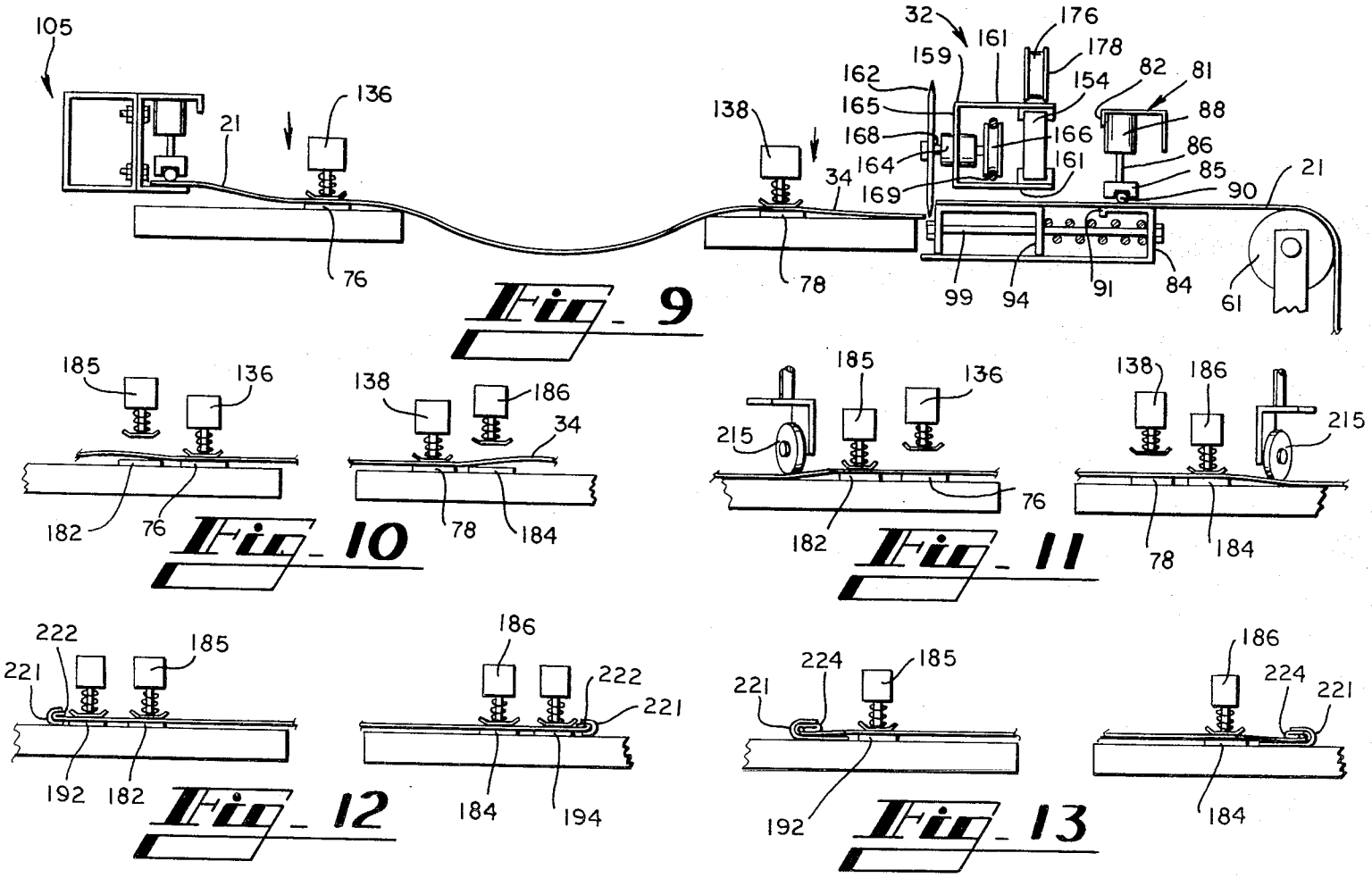

As illustrated in FIGS. 5, 6 and 9, cutter 32 comprises a rectilinear guide beam 154 which extends across the entrance 130 of the cutting station at the movable support means 94. A carriage 155 is mounted on cutter guide beam 154 and includes upper and lower brackets 156 and 158 mounted about the upper and lower surfaces of guide beam 154, and U-shaped housing 159 having its upper and lower legs 160 and 161 mounted to brackets 156 and 158. Cutter disc 162 is mounted, by means of bearing 164, in the side wall 165 of U-shaped housing 159, with the axis of rotation of the cutter extending in a horizontal plane and with the disc 162 extending in a vertical plane. A drive pulley 166 is connected to the disc drive shaft 168, and drive band 169 extends about pulley 166. A pair of idler pulleys 170 and 171 direct the guide band 169 around approximately 180° to the drive pulley 166, causing the drive band to frictionally engage and rotate drive pulley 166. Reversible electric motor 172 is mounted at the end of cutter guide beam 154, and its driven pulley 174 has drive band 169 wrapped therearound. The band is also wrapped around idler pulley 175 at the other end of cutter guide beam 154. Thus, when electric motor 172 is energized, the movement of band 169 along its length causes disc 162 to rotate.

Carriage conveyor belt 176 is mounted at its ends about pulleys 178 and 179, and the pulleys 178 and 179 are mounted to the ends of cutter guide beam 154 by means of support straps 180. Reversible air motor 181 has its output shaft connected to pulley 179 and is arranged to drive carriage conveyor belt 176. Carriage conveyor belt 176 is connected to the top surface of carriage 155, so that movement of the carriage conveyor belts causes carriage 155 to traverse cutter guide means 154 and move cutting disc 162 across the sheet material.

As illustrated in FIG. 5, second pair of conveyor tape assemblies 182 and 184 are located in the transfer section 36 of the assembly, with the conveyor tape assemblies 182 and 184 being located parallel to and outside of the conveyor tapes 76 and 78. Conveyor tape clamp bars 185 and 186 are located over conveyor tapes 182 and 184, with the pneumatic cylinders 188 and their rods 189 supporting clamp bar 185 and with the pnuematic cylinders 190 and their rods 191 supporting clamp bar 186. The clamp bars 185 and 186 are supported directly over conveyor tapes 182 and 184 and are movable down toward and up away from engagement with the conveyor tapes and the sheet material carried thereon.

Folding tapes 192 and 194 are positioned in the hemming section 40 and are positioned parallel to and outside of conveyor tapes 182 and 184. Clamp bars 195 and 196 are also supported over folding tapes 192 and 194 by their cylinders 198 and 200 and their rods. Sewing machines 201 and 202 are located on work tables 72 and 74. The folding belts 192 and 194 and sewing machines 201 and 202 function in the manner illustrated in U.S. Pat. No. 3,906,878 to fold over and sew the edge portions of the sheet material moving through the hemming section 40.

Figure 15:
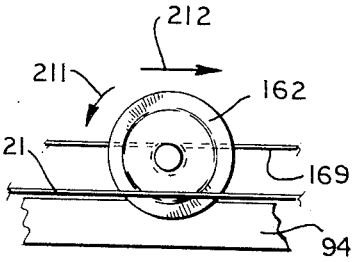
FIG. 15 is a schematic end view of the cutting disc, the sheet material, the disc band and the movable support means.

As illustrated in FIGS. 8–14, the conveyor tape clamp bars such as clamp bars 136 and 138 each include a rectilinear bar 204, a plurality of vertical holds are formed through the bar, and pins extend downwardly through the holes, with the heads 206 resting on the upper surfaces of the bar 204, and with the stems 208 extending down beneath the bars 204. A slide or foot 209 is mounted on the bottom of pins 208, and a coil compression spring 210 biases the foot downwardly away from the bar 204. The conveyor tape clamp bars 136 and 138 are moved to their up positions by their cylinders 139 when gripping means 105 moves as indicated by arrow 211 away from the entrance 130 of the cutting station 31 to its home position 131. After the gripping member has reached its home position, the clamp bars 136 and 138 move down toward engagement with the sheet material 21, over conveyor tapes 76 and 78. Cutter 32 is then energized, by air motor 181 moving carriage conveyor belt 176, causing the carriage 155 and disc cutter to move along the length of cutter guide beam 154. In the meantime, electric motor 172 is energized to move its drive band 169 about drive pulley 166 of disc cutter 162, causing disc cutter 162 to rotate. The combined action is illustrated in FIG. 15, where the disc cutter 162 rotates as indicated by arrow 211 as the carriage moves in the direction indicated by arrow 212. This causes the cutting periphery of the cutter disc to be moving upwardly into the sheet material 21 as the cutter disc moves into the sheet material. Also, movable support means or beam 94 is urged by its springs 101 into the cutter disc, assuring that the sheet material 21 is stabilized immediately adjacent the cutter disc 162. When the cutter disc 162 is moved in the opposite direction, it also will be rotated in the opposite direction, giving the same action. Thus, the sheet material will be cut by cutter 32 when gripping means 105, clamp bars 136 and 138 and clamp assembly 81 have engaged the sheet material 21, thereby holding the sheet material in a stable condition.

After the cutter has completed the cut across the sheet material to form a cut segment 34, gripping means 105 releases the sheet material 21 and the conveyor tapes 76 and 78 begin their movement, to move the cut segments 34 in a direction parallel to its cut ends from the cutting station 31 to the transfer station 36.

The sheet material will always be guided into the cutting station so that it spans the passageways 79 and 80 between the work table sections 72*a* and 72*b* and 74*a* 74*b*, so that the edge of the sheet material leading from the cutting station to the transfer station does not have to be guided over the passageways 79 and 80.

When the cut segment of sheet material moves into transfer station 36 by conveyor tapes 76 and 78 (FIG. 10) the cut segment moves onto conveyor tapes 182 and 184. When the cut segment is completely in transfer station 36, the conveyor tape clamp bars 185 and 186 move down into engagement with the sheet material 21 while the conveyor tape clamp bars 136 and 138 are lifted up out of contact with the sheet material (FIG. 11). When the hemmer at hemming station 40 is ready to receive the cut segment 21, the conveyor tapes 182 and 184 will begin their movements, causing the sheet material to be moved into the hemming station. The conveyor tapes 182 and 184 operate in timed relationship with the hemmers, which is slower than the movement of conveyor tapes 76 and 78 at the cutting station 31.

Figure 16:
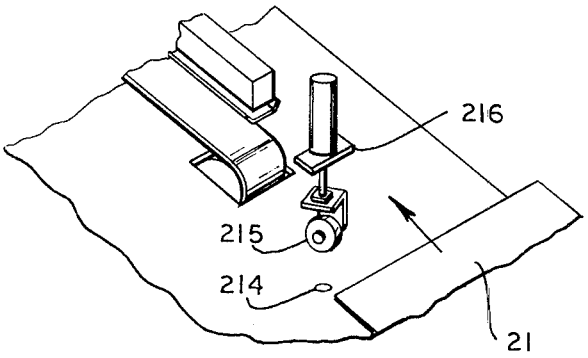
FIG. 16 is an illustration of one of the sheet alignment wheels.

As illustrated in FIG. 16, a photoelectric cell 214 is located in each work table 72 and 74, and a wheel 215 is supported by bracket 216, cylinder 218, and cylinder rod 219 above the surface of the work table. The photoelectric cells 214 functions as a means for detecting the presence or absence of the side edge of the sheet material 21, thereby determining if the weight of the central portion of the sheet material has pulled the edge of the sheet material out of alignment with the hemmer. If the photoelectric cell sees darkness, no action is taken; if the photoelectric cell 214 sees light, it knows that the edge of the sheet material has been moved inwardly and out of alignment with the hemmer, and through its control means (not shown) actuates cylinders 216, to bring the wheel 215 down into engagement with the moving sheet material. Wheel 215 is angled so that its axis of rotation extends at an angle other than 90° from the direction of movement of the cut segments of the sheet material, thereby tending to walk the sheet material laterally with respect to its direction of movement. Thus, the wheel 215 adjusts the path of movement of the edge of the cut segment of sheet material as it approaches the material.

Figure 14:
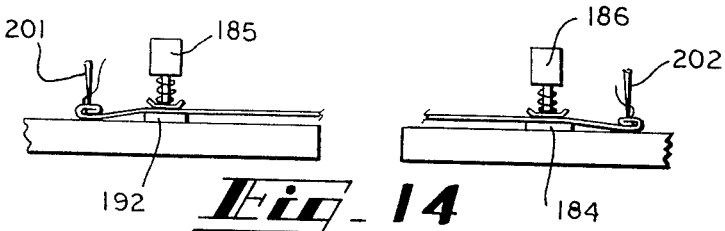

As the sheet material moves on into the hemming station, the conveyor tape clamp bars 185 and 186 remain in their down positions, and the sheet material 21 moves on into the hemmer, and onto the folding belts 192 and 194. A static folder 221 forms the first small fold 222 in the sheet, and the static folder then folds the belt over onto the sheet material, thus creating the second fold 224. The sewing machines 201 and 202 then sew through the fold (FIGS. 12–14). This structure and function is disclosed in more detail in U.S. Pat. No. 3,906,878.

Figure 17:
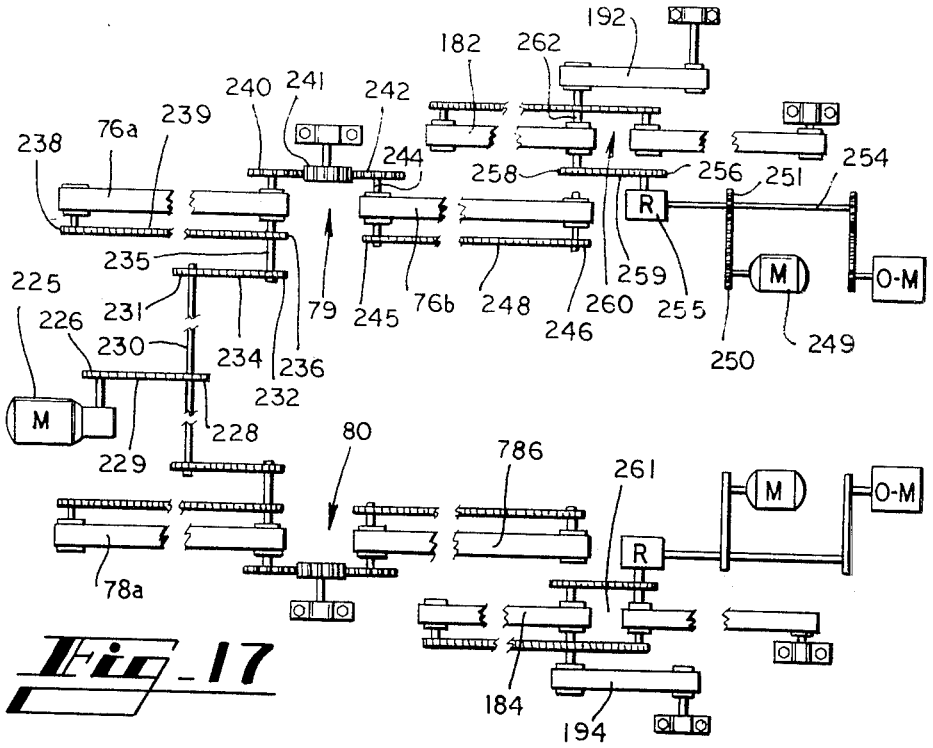
FIG. 17 is a schematic illustration of the drive system for the cutting station and hemming station.

As illustrated in FIG. 17, the drive system for the conveyor tapes in the cutting section comprises motor 225 which drives through sprocket 226 and 228 and chain 229, the main drive shaft 230. The drive systems for each conveyor tape are similar and include drive sprocket 231 and 232 with their connecting chain 234, shaft 235, sprockets 236 and 238 and their connecting chain 239, and conveyor tape **76*a* and 78*a*. Shaft 235 also extends through conveyor tape 76*a* and 76*b* to gear 240 which is connected through gears 241 and 242 to shaft 244 which drives conveyor tape 76*b* and 78*b*, sprockets 245 and 246 and their connecting chains 248**.

The hemmer drives are similar to each other and each includes a motor 249, drive pulleys 250 and 251 and their connecting belt 252, drive shaft 254, gear reducer 255, sprockets 256 and 258 and their connecting chain 259 and conveyor tape 182 and 184. Conveyor tapes 182 and 184 are also broken in a manner similar to conveyor tapes 76 and 78 so as to provide a space 260 and 261 into which the sewing machine fit. The folding belts 192 and 194 are driven from drive shaft 262.

Figure 18A:
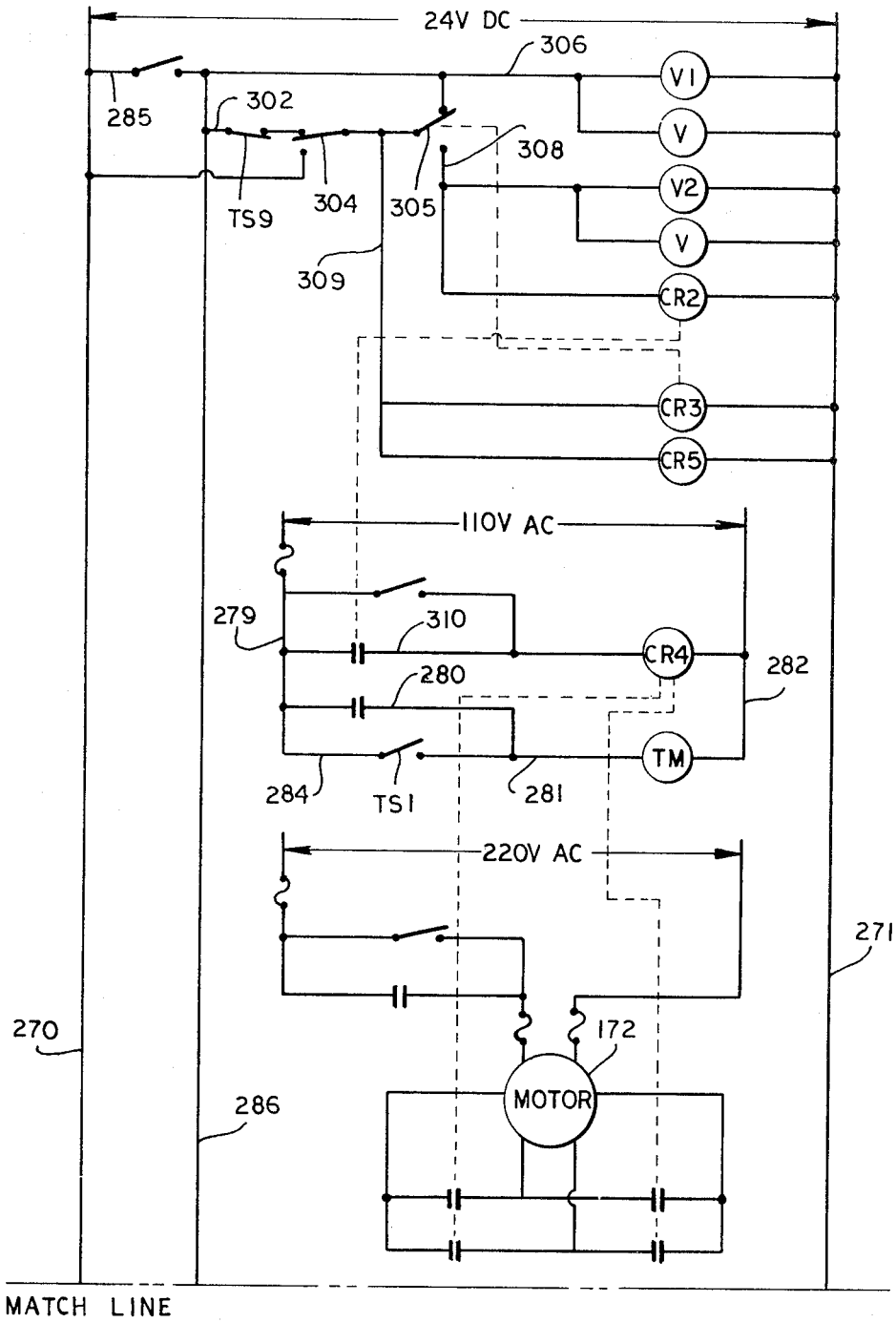
FIGS. 18A and 18B are composit electrical diagrams of the control system for the cutting station.
Figure 18B:
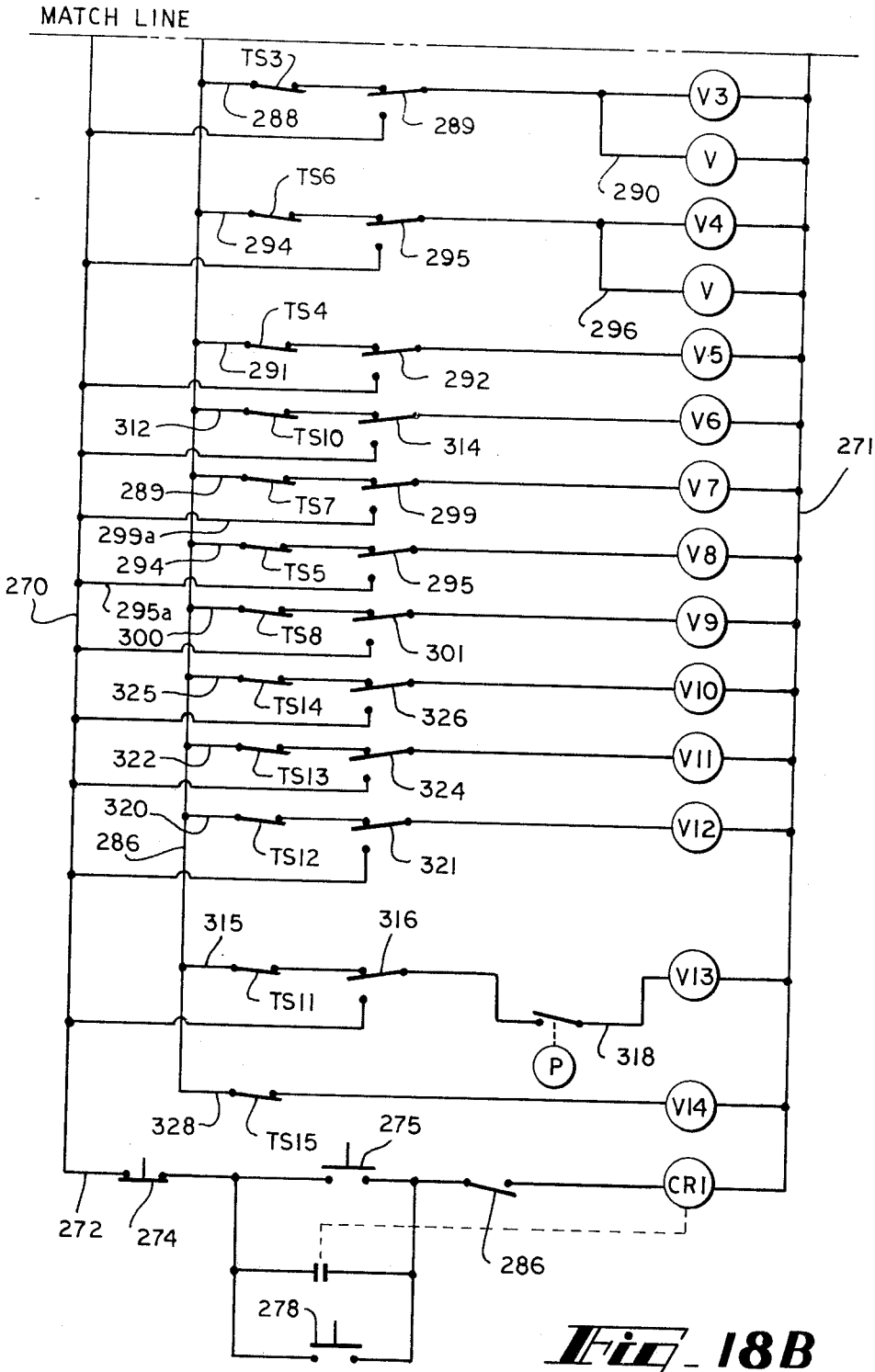

As illustrated in FIG. 18, three circuits are used to control the system. The first circuit is a 24 volt DC circuit, the second circuit is a 110 AC circuit, and the circuit is a 220 AC circuit.

The 24 volt DC circuit comprises main conductors 270 and 271, with conductor 270 being the negative conductor and conductor 271 being the positive conductor. A plurality of switches appear in the circuit and are termed timing switches. These switches are opened and closed by cams mounted on a rotatable cam shaft (not shown), with the cam shaft being driven by a timing motor.

Main conductor 270 is connected to conductor 272, which includes first stop switch 274, first start switch 275, accumulator switch 276 and the coil of first control relay CR1. Also connected in parallel with start switch 275 is second start switch 278 and the second contacts CR1-2 of the control relay CR1. Thus, the second contact CR1-2 forms a holding circuit through the coil of the control relay.

Figure 19:
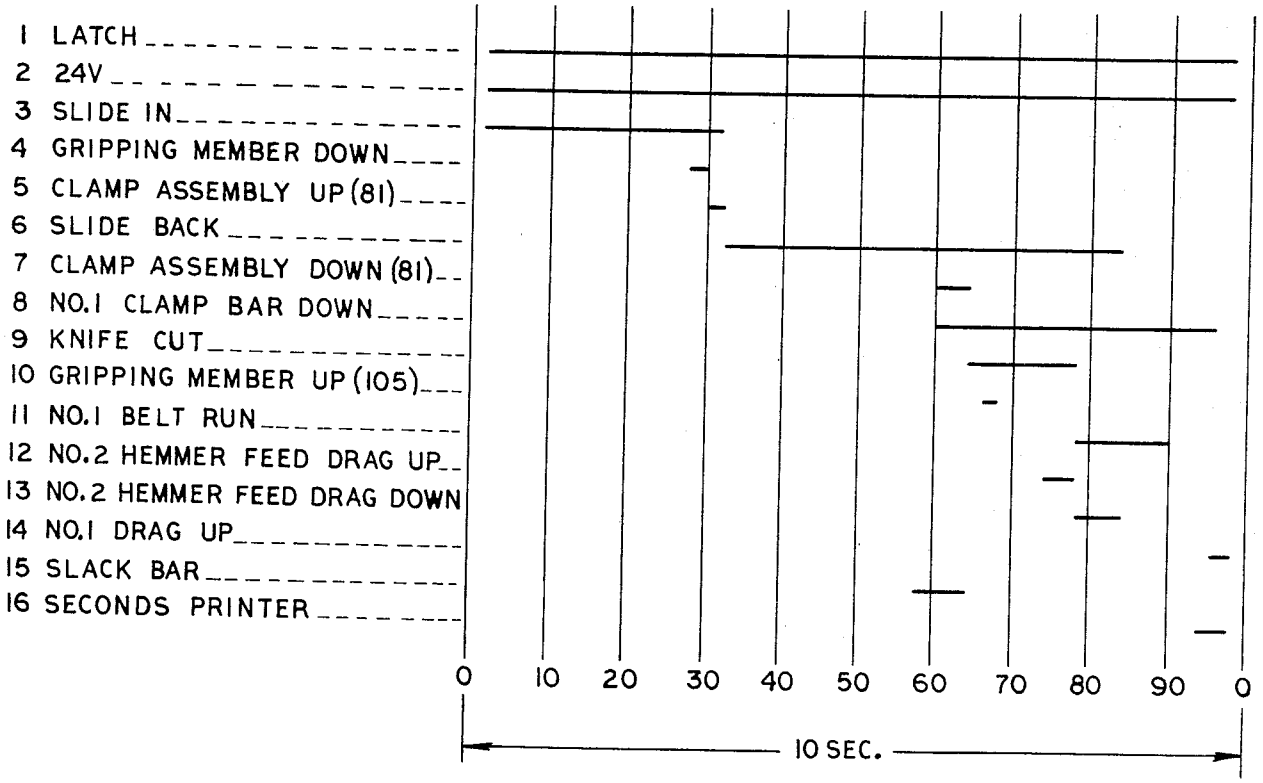
FIG. 19 is a time graph showing the sequence of operation of the switches actuated by the cam system.

The coil of control relay CR1 in conductor 272 also closes the contacts CR1-1 in the 110 AC circuit, making a circuit from main conductor 279, through conductor 280, 281, timing motor TM and main conductor 282. When timing motor TM begins its operation, it immediately closes timing switch TS1, making a circuit from main conductor 279 through conductor 284, timing switch TS1, conductor 281, timing motor TM to main conductor 282. This causes timing motor TM to continue its operation. When considering this function in connection with FIG. 19, it will be seen that switches TS1 and TS2 are first to close and last to open. Timing switch TS2 makes a circuit from main conductor 270 through conductor 285 and then through main conductor 286. Thus, timing switch TS2 functions to energize common conductor 286 to which most of the DC circuits are made.

Timing switch TS3 is in a circuit form common line 286 through conductor 288 through manual switch 289, to pilot valve V3 which causes air motor 129 to move the gripp bar 105 from is home position to the entrance position of the cutting station 31. In addition, in order to cushion the impact of the gripping bar 105 as it moves into the entrance 131 of the cutting station, valve V is energized parallel with pilot valve V3 through conductor 290, to charge a plurality of dash pots (not shown) which engage the oncoming gripping bar.

After the gripping member has reached the entrance of the cutting station 31, the cam system closes timer switch TS4 which makes a circuit from common line 286 through conductor 291, manual switch 292, and pilot valve V5 to main conductor 271. This causes the gripping bar to moves its upper clamp member down against the lower clamp member 110 and to grip the leading edge portion **21*c* of the sheet material 21**.

After the gripping bar is in gripping relationship with the leading edge portion of the sheet material, the clamp assembly 81 is moved up. This is accomplished by a cam on the cam shaft closing timer switch TS5 which makes a circuit from common 286 through conductor 294, through manual switch 295, through pilot valve V8 to main conductor 271.

As soon as the clamp assembly is up to release the leading edge portion of the sheet material, the gripping bar is moved from the entrance position at the cutting station back to its home position to pull the sheet on into the cutting station 31. This is accomplished by closing timer switch TS6 which makes a circuit from common 286 through conductor 294, manual switch 295 through pilot valve V4 to main conductor 271. Also, a circuit is made through conductor 296 to dash pots (not shown)

through valve V. The dash pots cushion the impact of the oncoming gripping bar 105.

After the sheet material has been pulled into the cutting station by the gripping bar, the slack must be formed in the segment of sheet material by moving the slack bar 144 down into the sheet material. This is accomplished by a cam closing timer switch TS15 which makes a circuit from common 286 through conductor 328 to pilot valve V14 to main conductor 271.

After the gripping member reaches its home position and slack has been formed in the sheet, the clamp assembly 81 is again moved into clamping relationship with the sheet material to hold the sheet material stable for the subsequent cutting step. This is accomplished by a cam closing timer switch TS7 which makes a circuit from common 286 through conductor 298, manual switch 299 and pilot valve V7 to main conductor 271.

The first pair of conveyor tape bars 136 and 138 are moved down into engagement with the sheet material toward their respective conveyor tapes 76 and 78 at the same time the clamp assembly is moved down to clamp the sheet material. This is accomplished by a cam closing the timer switch TS8 which makes a circuit from common 286 through conductor 300, manual switch 301, through pilot valve V9 to main conductor 271. Pilot valve V9 causes the pneumatic cylinders 139 and 141 of the clamp bars to move the clamp bars down into engagement with the sheet material.

Now that the conveyor tape clamp bars, the clamp assembly and the gripping bar have all grasped the segment of sheet material extending through the cutting section 31, the cutter disc is actuated to cut across the sheet material. This is accomplished by a cam closing the timer switch TS9 which makes a circuit from common 286 through conductor 302, manual switch 304, and stepping switch 305 through either of conductors 306 or 308 to pilot valves V1 or V2 and to dash pot valves V which are in parallel with the pilot valves V1 and V2. Also, a parallel circuit is made through conductor 309 through the coil of stepping relay CR3 and through the coil of the blade run relay CR5. The contacts 305 of stepping relay CR3 move alternately to charge conductor 306 or 308, to move the knife in one direction and then in the other direction. Also, control relay CR2 in the 24 volt circuit closes its contact CR2-1 in the 110 AC circuit, making a circuit from conductor 279 through conductor 310 to control relay CR4 to conductor 282. Control relay CR4 closes its contacts CR4-1 in the 220 AC circuit, or closes its contact CR4-2, causing the cutter disc motor 172 to reverse and begin operation.

As the cutter disc is making its cut through the sheet material, the gripping bar 105 releases the leading edge of the sheet material. This is accomplished by closing timer switch TS10 which makes a circuit from common 286 through conductor 312, through manual switch 314 to pilot valve V6 and main conductor 271.

After the cut in the sheet material has been completed and the gripping bar is opened, the first pair of conveyor tapes begin their movements to move the sheet material in a direction extending along the cut edges thereof to the transfer station. This is accomplished by closing timer switch TS11 which makes a circuit from common 286 through conductor 315, manual switch 316, through a photocell circuit 318, to pilot valve V13 to main conductor 271. Pilot valve V13 actuates motor 225 and motor 225 continues to run until the photocell P in photocell circuit 318 sees the oncoming edge of the sheet material, whereupon the circuit to pilot valve V13 is opened, thereby causing the sheet to stop.

When the cut segment of sheet material is moving from the cutting station 31 to the transfer station 36, the second conveyor tape clamp bars 136 and 138 must be raised momentarily in order to avoid retarding the movement of the oncoming edge of the cut segment of sheet material. This is accomplished by closing timer switch TS12 which makes a circuit from common 286 through conductor 320, manual switch 321 to pilot valve V12 to main conductor 271. Immediately thereafter, the conveyor tape clamp bars 136 and 138 must be lowered again. This is accomplished by closing timer switch TS13 which makes a circuit from common 286 through conductor 322, manual switch 324 through pilot valve V11 to main conductor 271.

After the sheet material has left the cutting station 31, the conveyor tape clamp bars **136*a* and 138*a* must be raised out of the way of the gripping member 105 so that the gripping bar can move back from its home position to the entrance position of the cutting station 31. This is accomplished by closing timer switch TS14 which makes a circuit from common 286 through conductor 325 through manual switch 326 through pilot valve V10 to main conductor 271**.

When a flaw appears in the sheet material the cut segment in which the flaw appeared is to be marked to identify that segment as having a flaw. The sheet inspection and marking system of the type disclosed in U.S. Pat. Application Ser. No. 956,791 is used to make the mark on the segment. In order to detect that the last portion of the segment of sheet material to be cut is moving into the cutting station, timer switch TS16 is closed and makes a circuit to the marking system (not shown).

The various manual switches identified throughout the circuit of FIG. 18 permit the operator to temporarily close a circuit to the various functional elements of the system. For example, when it is desired to raise or lower the clamp assembly 81, the manual switch 299 or 295 can be moved from its normally closed position with its conductor 298 or 294 to a parallel conductor **299*a* or 295*a* to make a circuit to main conductor 270**.

While this sheet production system has been described in context with a system for manufacturing bed sheets, it will be understood that the system can be used to form other flat products such as towels and tablecloths. While this invention has been described in detail with particular reference to a preferred embodiment thereof, it will be understood that variations and modifications can be effected within the spirit and scope of the invention as described hereinbefore and as defined in the appended claims.

We claim:

1. Apparatus for cutting and hemming sheet material comprising means for moving sheet material along its length from a supply toward a cutting station, first clamp means at the entrance of the cutting station for holding the sheet material, gripping means movable between the entrace of the cutting station to the other side of the cutting station, a first pair of parallel conveyor tapes positioned in said cutting station, clamp means movable toward and away from said parallel conveyor tapes for urging the segment of the sheet material in the cutting station against the conveyor tapes, and means movable into the segment of the sheet material in the cutting station for forming slack in the sheet material.

2. The apparatus of claim 1 and wherein said means movable into the segment of the sheet material comprises a rectilinear slack bar movable from a position above the segment of sheet material in the cutting station down into the sheet material.

3. The apparatus of claim 1 and further including a second pair of parallel conveyor tapes located outside said first pair of parallel conveyor tapes and extending beyond said first pair of parallel conveyor tapes, clamp means movable toward and away from said second pair of parallel conveyor tapes for urging the cut segments of sheet material received on said second pair of parallel conveyor tapes from said first pair of parallel conveyor tapes against said second pair of parallel conveyor tapes, whereby the second pair of parallel conveyor tapes move the cut segment of sheet material into a hemmer.

4. Apparatus of claim 3 and further including means for detecting the edges of the cut segments of the sheet material as the cut segments move into a hemmer, a wheel movable into contact with the cut segments with the axis of rotation of the wheel extending at an angle other than 90° from the direction of movement of the cut segments, and control means responsive to the detection of a cut edge of the sheet material being displaced from the desired path toward the hemmer for moving said wheel down into contact with the sheet material.

5. The apparatus of claim 1 and further including folding means positioned along the length of the sheet material between the supply of sheet material and the cutting station, said folding means comprising first guide means extending across the sheet material from one edge of the sheet material for guiding the sheet material thereover, a second guide means positioned downstream from and lower than said first guide means and extending across the sheet material from a position displaced inwardly from the edge of the sheet material for guiding the central portion of the sheet material therebeneath, and an upwardly extending guide member positioned at the end of the second guide means, and a third guide means positioned at approximately the same level as said second guide means, whereby the sheet material moves over the first guide means, then the central portion of the sheet material moves down beneath the second guide means and the edge portion of the sheet material folds upwardly adjacent the upwardly extending guide member, and the central portion of the sheet material moves to the third guide means and the edge portion of the sheet material folds over onto the central portion as the edge portion moves from the upwardly extending guide member to said third guide means.

6. The apparatus of claim 1 and further including movable suport means adjacent the entrance to said cutting station for supporting the leading edge portion of the sheet material in a horizontal attitude, and wherein said gripping means comprises a lower clamp member movable into abutment with said movable support means to move the movable support means inwardly beneath the leading edge portion of the sheet material and to move the lower clamp member beneath the leading edge portion of the sheet material, and an upper clamp member positioned above said lower clamp member and means for moving said upper and lower clamp elements together about the leading edge portion of the sheet material to grip the sheet material.

7. The apparatus of claim 1 and further including cutting means positioned between said first clamp means and said parallel conveyor tapes for cutting the sheet material at the entrance to the cutting station.

8. The apparatus of claim 7 and wherein said cutting means comprises track means, a carriage mounted on said track means, a cutting disc, movable with said carriage on said track means back and forth across the sheet material, a carriage drive motor, drive means extending between said carriage drive motor and said carriage for moving said carriage along said track means, and a stationary reversible blade drive motor, band means extending from said blade drive motor to said cutting disc for rotating said cutting disc as said cutting disc moves across the sheet material.

9. Apparatus for cutting and hemming sheet material comprising means for moving sheet material along its length from a supply toward a cutting station, first clamp means at the entrance of the cutting station for holding the sheet material, gripping means movable between the entrace of the cutting station to the other side of the cutting station, a first pair of parallel conveyor tapes positioned in said cutting station, clamp means movable toward and away from said parallel conveyor tapes for urging the segment of the sheet material in the cutting station against the conveyor tapes, and cutting means at the entrance of said cutting station for cutting the segment of the sheet material in the cutting station away from the supply.

10. The apparatus of claim 9 and further comprising a rectilinear slack bar movable from a position above the segment of sheet material in the cutting station down into the sheet material.

11. The apparatus of claim 9 and further including a second pair of parallel conveyor tapes located outside said first pair of parallel conveyor tapes and extending beyond said first pair of parallel conveyor tapes, clamp means movable toward and away from said second pair of parallel conveyor tapes for urging the cut segments of sheet material received on said second pair of parallel conveyor tapes from said first pair of parallel conveyor tapes against said second pair of parallel conveyor tapes, whereby said second pair of parallel conveyor tapes move the cut segment of sheet material into a hemmer.

12. The apparatus of claim 9 and wherein said cutting means comprises track means, a carriage mounted on said track means, a cutting disc, movable with said carriage on said track means back and forth across the sheet material, a carriage drive motor, drive means extending between said carriage drive motor and said carriage for moving said carriage along said track means, and a stationary reversible blade drive motor, band means extending from said blade drive motor to said cutting disc for rotating said cutting disc as said cutting disc moves across the sheet material.

13. In a sheet cutting apparatus wherein sheet material is moved from a supply along its length to a cutting station, the improvement therein of movable support means adjacent the entrance to said cutting station for supporting the leading edge portion of the sheet material in a horizontal attitude, a gripping means comprising a lower clamp member movable into abutment with said movable support means to move the movable support means inwardly beneath the leading edge portion of the sheet material and to move the lower clamp member beneath the leading edge portion of the sheet material, and an upper clamp member positioned above said lower clamp member and means for moving said upper and lower clamp elements together about the leading edge portion of the sheet material to grip the sheet material.

* * * * *